US009458669B2

(12) United States Patent
Heichel et al.

(10) Patent No.: US 9,458,669 B2
(45) Date of Patent: Oct. 4, 2016

(54) DRILLING TABLE

(71) Applicant: ABI Anlagentechnik-Baumaschinen-Industriebedarf Maschinenfabrik und Vertriebsgesellschaft mbH, Niedernberg (DE)

(72) Inventors: Christian Heichel, Niedernberg (DE); Holger Bube, Miltenberg (DE)

(73) Assignee: ABI Anlagentechnik-Baumaschinen-Industriebedarf Maschinenfabrik und Vertiebsgesellschaft mbH, Niedernberg (DE)

( * ) Notice: Subject to any disclaimer, the term of this patent is extended or adjusted under 35 U.S.C. 154(b) by 369 days.

(21) Appl. No.: 14/167,208

(22) Filed: Jan. 29, 2014

(65) Prior Publication Data

US 2014/0216820 A1 Aug. 7, 2014

(30) Foreign Application Priority Data

Feb. 6, 2013 (DE) ..... 20 2013 100 548 U

(51) Int. Cl.
*E21B 3/04* (2006.01)

(52) U.S. Cl.
CPC ..... *E21B 3/04* (2013.01)

(58) Field of Classification Search
CPC ..... E21B 3/04
See application file for complete search history.

(56) References Cited

U.S. PATENT DOCUMENTS 2,970,458 A * 2/1961 McLerran ..... E21B 3/04 403/51

* cited by examiner

*Primary Examiner* — Brad Harcourt
(74) *Attorney, Agent, or Firm* — Collard & Roe, P.C.

(57) ABSTRACT

A drilling table for a drilling rig has an accommodation sleeve that can be rotated via a rotational drive for accommodation of a Kelly rod provided with driving contours. Coupling elements are disposed on the inside wall of the accommodation sleeve for engagement into the driving contours of the Kelly rod for transfer of torque and bias forces. Broken-out areas are introduced into the accommodation sleeve, through which areas the coupling elements that can be inserted from the outside are passed, to project into the sleeve interior. A drilling rig has such a drilling table.

8 Claims, 2 Drawing Sheets

DRILLING TABLE

CROSS REFERENCE TO RELATED APPLICATIONS

Applicant claims priority under 35 U.S.C. §119 of German Application No. 20 2013 100 548.7 filed Feb. 6, 2013, the disclosure of which is incorporated by reference.

BACKGROUND OF THE INVENTION

1. Field of the Invention

The invention relates to a drilling table for a drilling rig, having an accommodation sleeve that can be rotated by means of a rotational drive, for accommodation of a Kelly rod provided with driving contours. The invention furthermore relates to a drilling rig having such a drilling table.

2. Description of the Related Art

For the production of bores having a large diameter, drilling rigs are used that work according to what is called the Kelly drilling method. In this connection, a specially profiled, multiple-telescoping drill rod, called a Kelly rod, is used. With the Kelly rod, the rotational movement or the torque of a drilling drive as well as the vertical movement or the bias forces are transferred to the drilling tool. The length of the Kelly rod and that of the drilling tool determine the maximal drilling depth that can be reached. The drilling drive is mounted on what is called a drilling table, also called a drilling carriage or guide carriage, which is disposed on a leader so as to be vertically displaceable. This leader is firmly disposed on a support device. The advance of the drilling table with the drilling drive, to generate the required bias forces, takes place by way of a cable feed or also by way of a hydraulic feed cylinder.

To transfer the torque as well as the bias forces from the rotational drive onto the Kelly rod that accommodates the drilling tool, this rod is locked in place in an accommodation sleeve of the drilling table by way of driver strips. The accommodation sleeve, which is disposed on the drilling table so as to rotate, is connected with the rotational drive of the drilling table. The driver strips for transfer of torque and bias forces to the Kelly rod are screwed or welded onto the inside wall of the accommodation sleeve.

It is a disadvantage of the known drilling table that the driver strips, which are disposed on the inside of the accommodation sleeve, and which must regularly be checked and/or replaced as the result of wear, are accessible only with difficulty. For disassembly of the driver strips, it is necessary either to climb in under the "floating" drilling table from below or to work by reaching into the accommodation sleeve, which is configured in the form of a hollow shaft, from above. Replacement can be facilitated in that the drilling table is removed from the leader and tilted toward the rear. Significant time expenditure, however, is required for this facilitation.

SUMMARY OF THE INVENTION

The invention wishes to provide a remedy for these disadvantages. The invention is based on the task of creating a drilling table for a drilling rig in which installation and removal of the driver strips is simplified. According to the invention, this task is accomplished by means of a drilling table for a drilling rig, having an accommodation sleeve that can be rotated by means of a rotational drive, for accommodation of a Kelly rod provided with driving contours, wherein coupling elements are disposed on the inside wall of the accommodation sleeve, for engagement into the driving contours of the Kelly rod, for transfer of torque and bias forces, wherein broken-out areas are introduced into the accommodation sleeve, through which areas the coupling elements that can be inserted from the outside are passed, to project into the sleeve interior.

With the invention, a drilling table for a drilling rig is created, in which the installation and removal of the driver strips is simplified. By passing the coupling elements, which are preferably structured as driver strips, through the broken-out areas of the accommodation sleeve into the sleeve interior, simple handling of these driver strips from the outside is achieved.

In a further development of the invention, at least one driver strip has a laterally projecting protrusion at least on one of its two longitudinal sides, thereby forming a T-shaped cross-section. In this way, a flange-like contact surface is formed, which allows defined orientation of the driver strips.

In an embodiment of the invention, at least one driver strip lies against the outside wall of the accommodation sleeve that circumvents a broken-out area with its lateral protrusions, whereby bores are introduced into the lateral protrusions. Using the bores, the driver strip is screwed onto the accommodation sleeve by way of screws. In this way, simple fastening of the driver strip, with simultaneous alignment, is made possible.

In a further development of the invention, a step is disposed in the accommodation sleeve, on two opposite sides of at least one broken-out area, thereby forming a stop against which a driver strip lies with its lateral protrusions. In this way, radial as well as axial alignment of the driver strip is achieved. In this connection, the step and the driver strip are preferably configured in such a manner that the outside surface of the driver strip that lies against the step fits into the mantle surface of the accommodation sleeve.

In an embodiment of the invention, means for radially securing at least one driver strip on the accommodation sleeve are provided, which are preferably formed by a securing plate that is releasably fastened onto the outside wall of the accommodation sleeve, covering a driver strip at least in certain regions. In this way, simple, radially and axially aligned fastening of a driver strip is achieved. Possible weakening of the lateral protrusions of the driver strips by means of bores for passing fastening screws through is not required. Instead, fastening takes place in the form of axial securing by means of the securing plate.

In an alternative embodiment of the invention, the means for radially securing the driver strips can also be formed by means of a securing sleeve that is pushed onto the accommodation sleeve. In this way, simultaneous securing of all the driver strips is made possible.

In an advantageous embodiment of the invention, openings are introduced into the securing sleeve. These openings are at least as large as the corresponding dimensions of the recesses of the accommodation sleeve, in terms of their length and width, and the securing sleeve can rotate on the accommodation sleeve. In this way, introduction of the driver strips through the broken-out areas of the accommodation sleeve is made possible while the securing sleeve is in place. Axial securing of the driver strips takes place by means of rotation of the securing sleeve.

The present invention is furthermore based on the task of creating a drilling rig having a drilling table that is guided along a leader, which table allows simple installation and removal of the driver strips. According to the invention, this task is accomplished by a drilling rig having a drilling table that has an accommodation sleeve and is guided along a leader, wherein a Kelly rod is introduced into the accommodation sleeve, which rod has a driver contour on its outside circumference into which the driver strips guided through the broken-out areas of the accommodation sleeve engage.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF PREFERRED EMBODIMENTS

Figure 1:
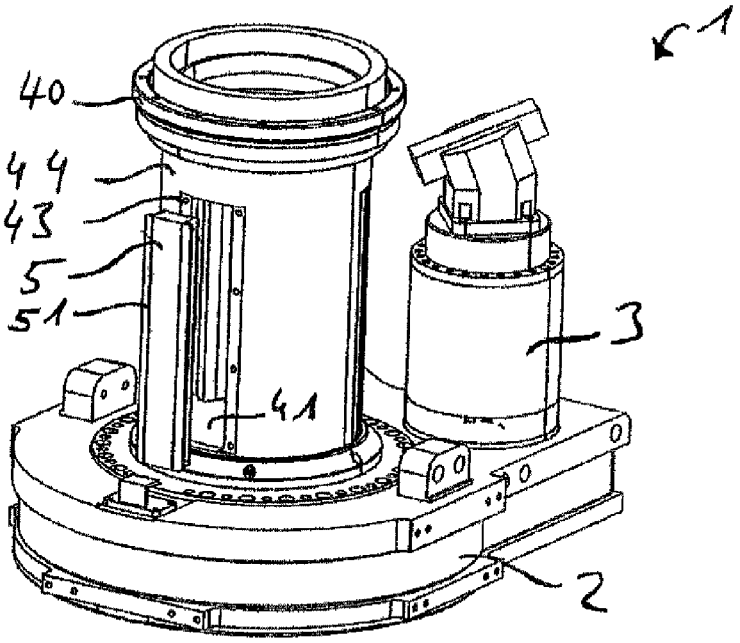
FIG. 1 is a schematic representation of a drilling table for a drilling rig, with driver strip removed.
Figure 2:
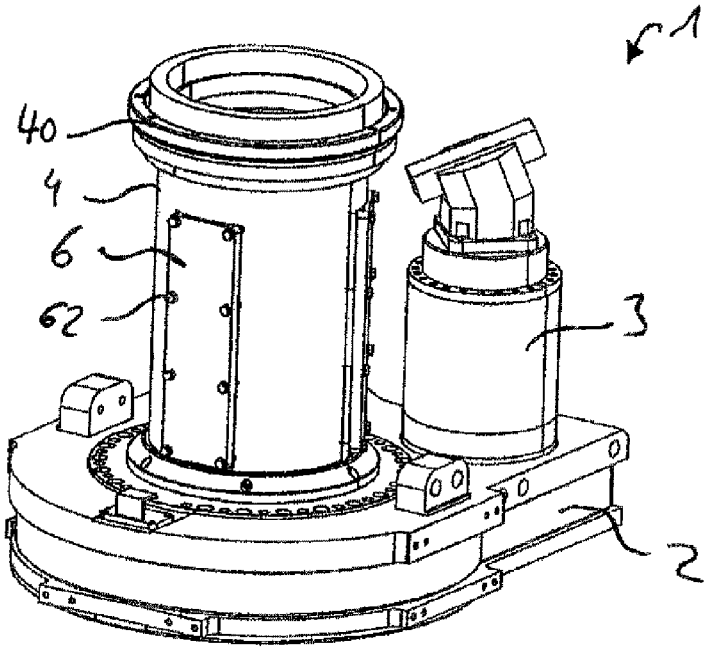
FIG. 2 is a schematic representation of the drilling table from FIG. 1, with driver strips installed and axially fixed in place with securing plates.

The drilling table 1 selected as an exemplary embodiment consists essentially of a carriage part 2 that can be mounted to be displaceable on a leader—not shown—and accommodates a rotational drive 3, which is connected with an accommodation sleeve 4 disposed so as to rotate, for accommodation of a Kelly rod—not shown—by way of a gear mechanism—not shown. The accommodation sleeve 4 is provided with three driver strips 5, disposed offset by 120 degrees, in each instance, which strips project through broken-out areas 41 introduced into the accommodation sleeve 4, through the walls of the accommodation sleeve 4, and which are fixed in place by means of a securing plate 6, in each instance.

The general structure of such a drilling table for accommodation of a Kelly rod is sufficiently known to a person skilled in the art, and for this reason the emphasis of the further description will be placed on the configuration and placement of the accommodation sleeve 4 as well as of the driver strips 5 accommodated by it.

The accommodation sleeve 4 is essentially structured as a hollow cylinder and at its end opposite the carriage part 2, has a radially projecting contact ring 40 for contact with a support ring disposed on the Kelly rod to be accommodated. Broken-out areas 41 configured in rectangular manner are introduced into the accommodation sleeve 4, offset by 120 degrees, in each instance, between contact ring 40 and carriage part 2. On the two longitudinal sides of the broken-out areas 41, a step 42 for contact of the protrusions 51 of the driver strips 5 is disposed in the accommodation sleeve 4, in each instance. Furthermore, threaded bores 43 for accommodation of screws 62 for fastening a securing plate 6 are provided.

The driver strips 5 are configured essentially in block shape. On their two longitudinal sides, a laterally projecting protrusion 51 is formed onto the driver strips 5, thereby causing the driver strips to have a T-shaped cross-section. The depth of the driver strip 5 is selected in such a manner that it passes through the wall of the accommodation strip 4 when the lateral protrusions 51 make contact with the step 42, and projects to a sufficient degree on the inside. The driver strip 5 is configured in such a manner that its outside surface 52 fits into the mantle surface 44 of the accommodation sleeve 4 when the lateral protrusions 51 lie against the step 42. The driver strips 5, which lie against the steps 42 of the accommodation sleeve 4 in this manner, are axially secured by way of a securing plate 6, in each instance, which plates are fastened onto the accommodation sleeve 4 by way of screws 62, completely covering the driver strip 5.

Figure 3:
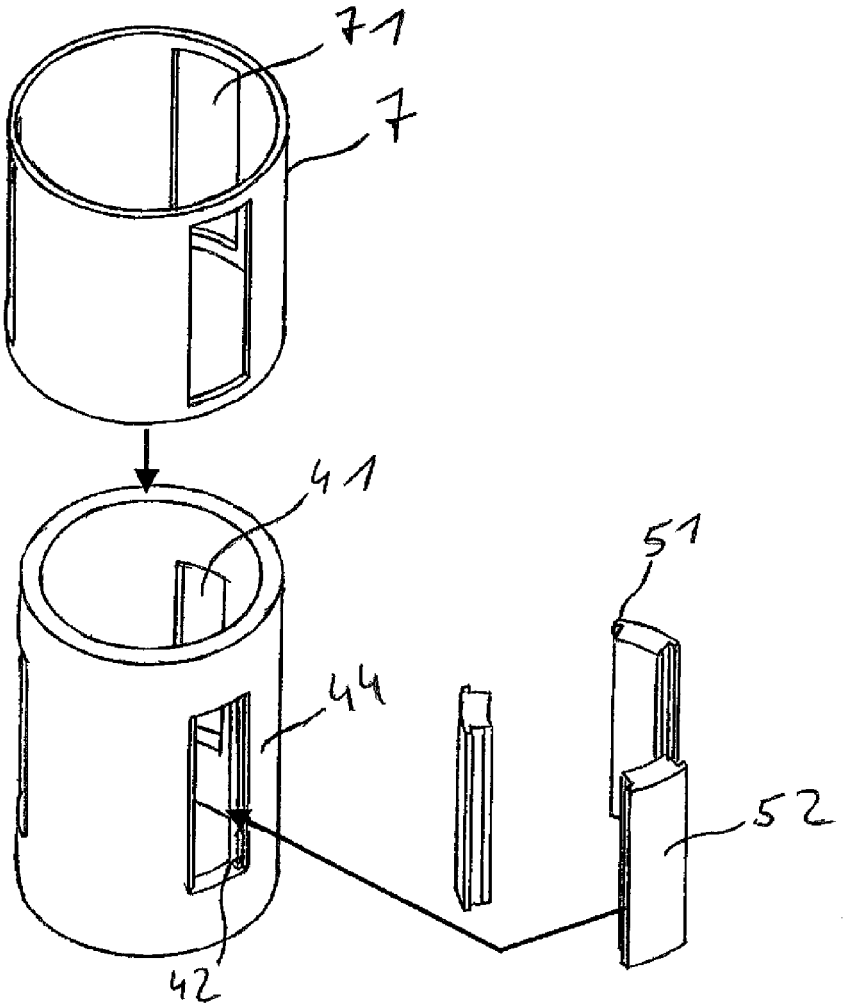
FIG. 3 is a schematic representation of the accommodation sleeve of the drilling table from FIG. 1, with securing sleeve, in an exploded view.
Figure 4:
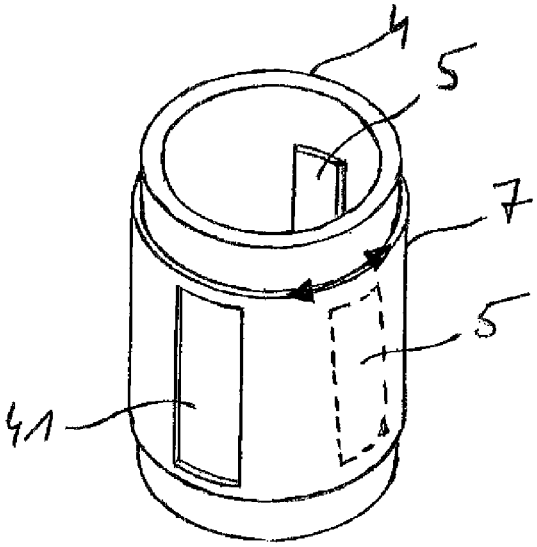
FIG. 4 is a schematic representation of the arrangement from FIG. 3, with driver strips introduced and secured.

In FIGS. 3 and 4, an alternative possibility of axially securing the driver strips 5 is shown. Here, a securing sleeve 7 is rotatably disposed on the accommodation sleeve 4, in place of the securing plates 6. The securing sleeve 7 is provided with rectangular openings 71 circumferentially, offset by 120 degrees from one another, in each instance, which openings are greater not only in their height but also in their width than the driver strips 5 provided with protrusions 51. For installation of the driver strips 5, the securing sleeve 7 is rotated on the accommodation sleeve 4 in such a manner that the openings 71 align with the broken-out areas 41 of the accommodation sleeve 4. After the driver strips 5 have been introduced through the broken-out areas 41 in such a manner that the protrusions 51 lie against the steps 42, the securing sleeve 7 is rotated by about 60 degrees, thereby causing all three driver strips 5 to be axially secured (cf. FIG. 4). Securing of this position of the securing sleeve 7 takes place, for example, by means of a screw or a bolt. In the event that the driver strips 5 project beyond the mantle surface 44 of the accommodation sleeve 4, the securing sleeve 7 can be provided with a circumferential groove on its inside wall, the width of which groove approximately corresponds to the height of the projecting driver strip 5. For removal of the driver strips 5, the securing sleeve 7 is once again rotated by about 60 degrees, thereby releasing the driver strips 5 for removal.

Although only a few embodiments of the present invention have been shown and described, it is to be understood that many changes and modifications may be made thereunto without departing from the spirit and scope of the invention.

What is claimed is:

1. A drilling table for a drilling rig comprising:

(a) a rotational drive;

(b) an accommodation sleeve rotatable by the rotational drive for accommodation of a Kelly rod having driving contours, said accommodation sleeve having an inside wall defining a sleeve interior and a plurality of broken-out areas; and (c) a plurality of coupling elements disposed on the inside wall of the accommodation sleeve for engagement into the driving contours of the Kelly rod to transfer torque and bias forces;

wherein the coupling elements are structured as driver strips, at least in part, and extend through the broken-out areas to project into the sleeve interior;

wherein at least one drive strip comprises a first longitudinal side having a first laterally projecting protrusion and a second longitudinal side having a second laterally projecting protrusion, thereby forming a T-shaped cross-section; and wherein each of the broken-out areas is surrounded by an outside wall of the accommodation sleeve and the at least one drive strip lies with the first and second laterally projecting protrusions against the outside wall, and wherein the first and second laterally projecting protrusions comprise bores for receipt of screws for fastening the at least one drive strip onto the accommodation sleeve.

2. The drilling table according to claim 1, wherein a step is disposed in the accommodation sleeve, on first and second opposite sides of at least one broken-out area, thereby forming a stop against which the at least one driver strip lies with the first and second laterally projecting protrusions.

3. The drilling table according to claim 2, wherein the step and the at least one driver strip are configured so that an outside surface of the at least one driver strip lies against the step and fits into a mantle surface of the accommodation sleeve (4).

4. The drilling table according to claim 3, wherein the at least one driver strip is radially secured on the accommodation sleeve.

5. The drilling table according to claim 4, further comprising a securing plate for radially securing the at least one driver strip on the accommodation sleeve, wherein the securing plate is releasably fastened onto the outside wall of the accommodation sleeve and covers the at least one driver strip at least in certain regions.

6. The drilling table according to claim 4, further comprising a securing sleeve for radially securing the at least one driver strip on the accommodation sleeve, wherein the securing sleeve is pushed onto the accommodation sleeve.

7. The drilling table according to claim 6, wherein the securing sleeve comprises a plurality of openings having length and width dimensions at least as large as corresponding length and width dimensions of the broken-out areas of the accommodation sleeve, wherein the securing sleeve is rotatable on the accommodation sleeve.

8. A drilling rig comprising:

a Kelly rod having a driver contour on an outside circumference of the Kelly rod; and a drilling table comprising:

(a) a rotational drive;

(b) an accommodation sleeve rotatable by the rotational drive and guided along a leader, said accommodation sleeve having an inside wall defining a sleeve interior and a plurality of broken-out areas, said accommodation sleeve receiving the Kelly rod introduced into the accommodation sleeve; and (c) a plurality of driver strips disposed on the inside wall of the accommodation sleeve;

wherein the driver strips extend through the broken-out areas to project into the sleeve interior and to engage into the driver contour;

wherein at least one drive strip comprises a first longitudinal side having a first laterally projecting protrusion and a second longitudinal side having a second laterally projecting protrusion, thereby forming a T-shaped cross-section; and wherein each of the broken-out areas is surrounded by an outside wall of the accommodation sleeve and the at least one drive strip lies with the first and second laterally projecting protrusions against the outside wall, and wherein the first and second laterally projecting protrusions comprise bores for receipt of screws for fastening the at least one drive strip onto the accommodation sleeve.

* * * * *